United States Patent [19]

Faltin

[11] 4,441,703

[45] Apr. 10, 1984

[54] PRESS DELIVERY SYSTEM WITH PRECISION PRODUCT TIMING AND ALIGNMENT

[75] Inventor: Hans G. Faltin, York, Pa.

[73] Assignee: Custom-Bilt Machinery, Inc., York, Pa.

[21] Appl. No.: 291,481

[22] Filed: Aug. 10, 1981

[51] Int. Cl.[3] ..... B65H 9/04

[52] U.S. Cl. ..... 271/243; 271/187; 271/272; 271/315

[58] Field of Search ..... 271/243, 244, 187, 315, 271/272, 273, 274, 72

[56] References Cited

U.S. PATENT DOCUMENTS

| | | | |
|---|---|---|---|
| 1,949,152 | 2/1934 | Fankboner | 271/315 |
| 2,397,044 | 3/1946 | Rapley | 271/315 |
| 2,403,062 | 7/1946 | Edwards | 271/315 X |
| 4,228,997 | 10/1980 | Schoonmaker | 271/315 |

*Primary Examiner*—Richard A. Schacher
*Attorney, Agent, or Firm*—Laurence R. Brown

[57] ABSTRACT

A system converts the timing, spacing and orientation of newspapers from a high speed rotary press to conform with the precision spacing and speed requirements of subsequent on-line paper processing equipment such as inserters, addressers, counters and bundlers. The critical precision timing feature provides a rotary member and belt meeting tangentially in a converging path into which papers from the press are fed. They are stopped at spaced index notches in the rotary member for precise spacing between papers, which are released for conveyance at the closely controlled belt-rotary member speed. Conveyance through the belt-rotary member over an arc distance in friction contact assures that they are started along a continuous synchronized on-line transport path with the precise control of spacing and movement required by the on-line processing equipment.

2 Claims, 2 Drawing Figures

PRESS DELIVERY SYSTEM WITH PRECISION PRODUCT TIMING AND ALIGNMENT

TECHNICAL FIELD

This invention relates to high speed on-line delivery and alignment of newspapers, magazines, and the like, which are printed on high speed rotary presses, and more particularly it relates to a system for the reception from a rotary press folder of such papers, magazines and the like, in a continuous precisely timed product; thus permitting these products to continue in perfect synchronization and alignment from the press folder to precision conveying systems, transporting said product to inserting, addressing, counting and bundling operations downstream from the press.

BACKGROUND ART

Traditionally papers are received from high speed rotary presses after folding by a rotating bucket receptacle sometimes called a "fan" or "star wheel" to reduce the speed of delivery to a transport system, delivering said products in an overlapped or shingled "format" for further processing. This method of delivery has two major faults. The first being that complete control of the product is temporarily lost in respect to alignment. The second fault is the fact that in order for the product to be withdrawn from the fingers of said bucket, it is necessary to bring said product to a complete stop while the fingers of the bucket extricate themselves. This stopped product is then dropped onto a moving belt where it changes its position relative to said belt in relationship to the speed of the press, i.e., in other words, the faster the press runs, the further back the product will fall on said belt in relationship thereto. This makes necessary further expensive retiming or jogging equipment to feed said product accurately onto other online operations, such as mentioned above.

It is, therefore, the objective of this invention to provide a replacement for said buckets with a method of keeping the press product in perfect alignment and time with the press operation regardless of the speed of the press.

To achieve the improved synchronous system, it is necessary to provide an improved rotary timing-speed converter and alignment mechanism which replaces the bucket delivery on rotary presses and thus permitting an even controlled flow of product.

Other objects, features, and advantages of the invention will be found throughout the following description, drawings and claims.

DISCLOSURE OF THE INVENTION

This invention provides for on-line processing of newspapers, magazines and the like printed on high speed rotary presses by delivering them at precisely timed and spaced intervals in exact orientation, so that they can be further processed by adding inserts, addressing, counting, bundling, etc. in on-line equipment without other special timing, orienting and spacing equipment.

Thus, products are delivered from a press along a delivery path leading into a converging gap between a moving belt and a rotating member with a circular periphery. The products are thus grasped frictionally and timed precisely by the rotating member rotation surface speed without bounce, flutter, misalignment or variations in spacing regardless of press speed.

The individual products are seated in sequence at stops in the circular periphery of the rotating member by the conveyor belt which is traveling at the same surface speed as the rotary member, which are simply notches, at the time the notches meet tangentially the delivery path at the point of convergence of the gap. The products are then grasped for conveyance about the circular periphery of the rotary member by the delivery belt and spring loaded pressure roller along an arc before being discharged, in precise shingled form, on the conveyor belt. Thus, the products are placed at a precise spacing determined by the notch spacing about the circular periphery at a precise speed determined by the rotation speed of the rotary member and not subjected to any bounce or jitter that could cause misalignment in the delivery sequence without coming to a complete stop.

The invention and its features are disclosed in more detail in the following description, drawings and claims.

DESCRIPTION OF A PREFERRED EMBODIMENT

Figure 1:
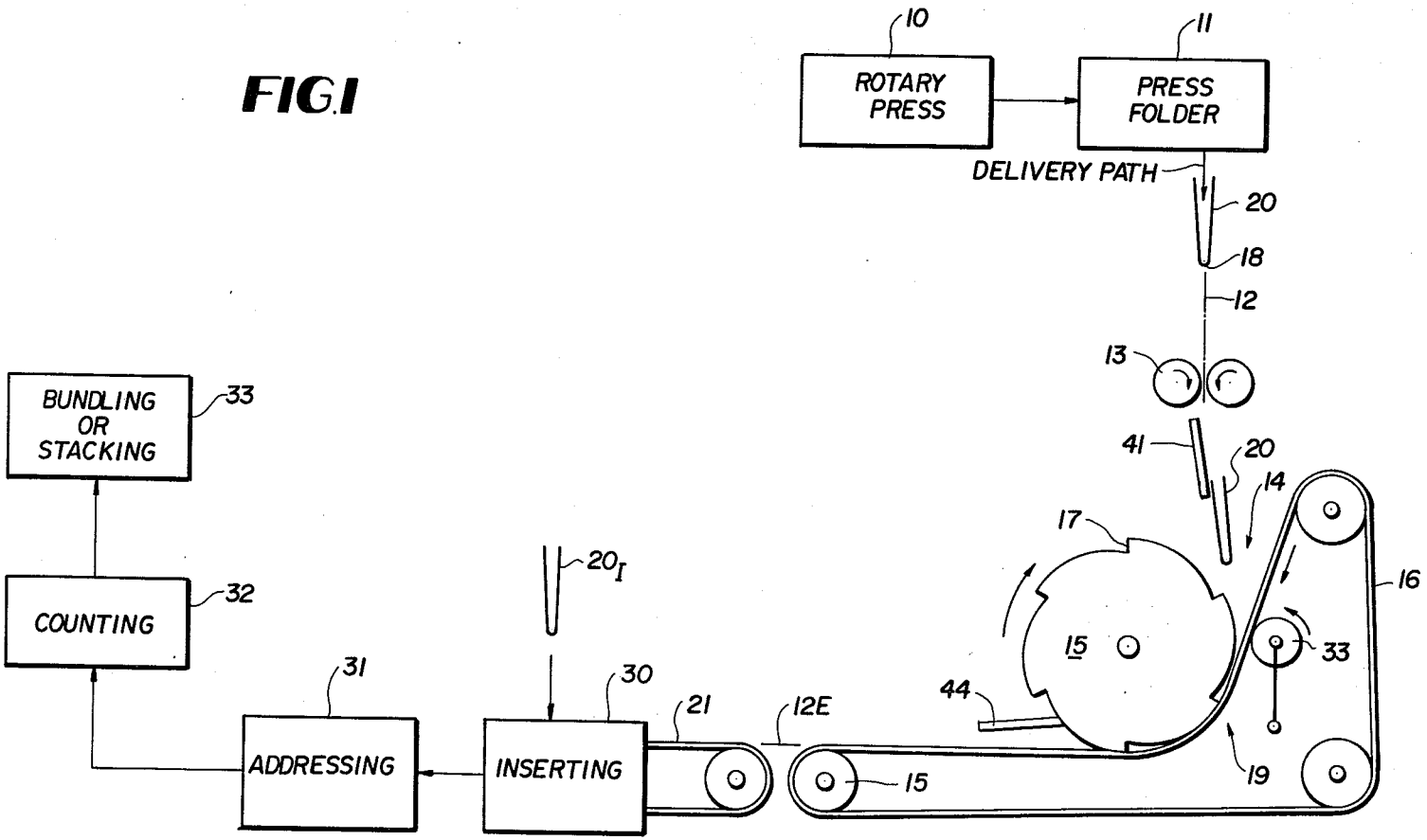
FIG. 1 is an on-line newspaper processing system schematic diagram partly in block form showing the path of a newspaper between a rotary press and a bundler.

A typical on-line paper processing system is shown in FIG. 1. Thus, papers are printed on the rotary press 10 and folded at quarter-folder 11 before delivery along a delivery path 12. A pair of nip rollers 13 adjacent the delivery path can receive the papers and direct them into a converging gap 14 between a rotary member 15 and associated flexible belt 16. The papers are then spaced precisely by stops comprising notches 17 on the rotary member, which may comprise a plurality of discs, a drum or the like for registering along the folded edge 18 of a newspaper.

The papers are then frictionally grasped on either side over the arc path 19 where the belt 16 engages the rotary member 15 on the papers held on the peripheral surface thereof. Therefore, the speed of delivery of the papers at exit path 12E is carefully controlled by the rotation speed of the rotary member 15 and associated belt 16. As seen better from the more detailed view of FIG. 2, the papers 20 are shingled as they pass through the arc path 19 and thus are delivered on the conveyor belt 21 transport path in shingled form. The mechanism therefore converts a higher vertical press delivery speed ($S_V$) to a lower horizontal conveyance speed ($S_H$). For timing the synchronous drive means 22 assures that the nip rollers 13, rotary member 15 and belt 16 are at appropriate speeds to receive sequential papers 20 into sequential notches 17 of the rotary member for exactly timed delivery at precisely spaced distances.

In this manner other processing devices typically including mechanisms for inserting signatures or the like 30, addressing 31, counting 32 and bundling or stacking 33 receive the papers in precisely timed and spaced sequence, so that further jogging, retiming and orienting apparatus is not necessary as in the case of bucket type speed converters which introduce jiggle and bounce in location of papers being delivered.

Figure 2:
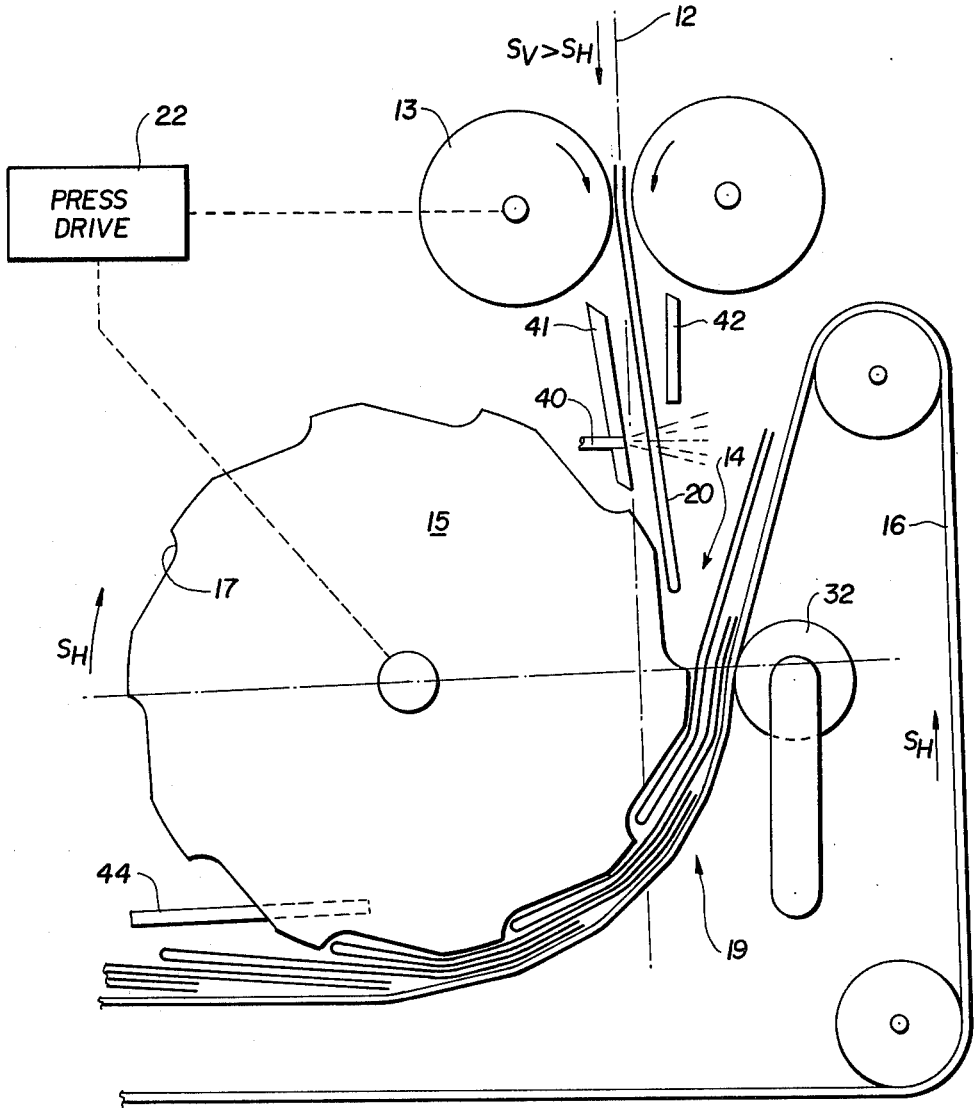
FIG. 2 is a diagrammatic end view sketch of a critical precision timer-speed converter-alignment device accepting newspapers from a high speed press and delivering them to an on-line processing system in precise synchronous timing and orientation.

Note as seen in FIG. 2, the air line 40 and guides 41, 42 direct the paper 20 fold forward into the gap 14 between the notched wheel 15 and belt 16. The nip rollers 13 give enough forward impetus to seat the paper in the notches 17 for frictional grasping by the belt 16 and wheel 15 as shown to be shingled and progress at appropriately reduced spacings between the papers.

Note spring loaded pressure roller 43 biased against the belt to assure that the papers are gripped where seated in the notches for proper frictional pressure before the belt is encountered at the tangential curved bottom periphery of notched wheel 15 for continued frictional conveyance in precise timing and spacing. Further conveyance belts (not shown) can thereafter reduce the speed or increase the speed to match desired processing equipment speed capabilities. The stripper bar 44 also assures that the shigled papers are not carried too far by the high wheel 15 periphery speed and corresponding centrifugal force before deposit on the conveyor belt, which is travelling at the same surface speed as the notched wheel 15 periphery. This is, if desired matched to the press discharge speed, and may in existing systems be used to replace open bucket delivery systems with the belt 16 and notched wheel 15 speed matched with the bucket periphery speed.

Industrial Application

A precision press delivery system accepts papers from a high speed rotary press on-line and precisely times and synchronizes the papers for transport through subsequent on-line processing stations.

I claim:

1. A high speed newspaper press delivery and processing system operable to receive papers exiting the press to precisely time, synchronize and locate them in a transport path and on-line processing system, comprising in combination, (a) means delivering at a transit speed folded papers from a high speed printing press along a predetermined delivery path, (b) a rotary timing placement and synchronizing member having a predetermined rotation speed and a substantially circular profile tangentially meeting said delivery path with a surface speed less than said transit speed and having a set of evenly spaced paper stop notches located about the circular periphery thereby to receive and space and shingle at a predetermined spacing the papers from said press with the papers in place in the notches constituting the outer circumferential shingled surface layer on the outermost circumferential surface of the rotary member, (c) a moving belt contacting an arc on the circular periphery of said rotary member from the intersection of the delivery path to a substantially lowermost position on the periphery thereby to contact the surface layer defined by the shingled papers between the belt and rotary member, to advance the papers at said rotation speed while holding them in a circumferentially fixed spacing and alignment and to discharge the papers in a continuous stream moving at the rotary member surface speed in a substantially horizontal direction tagential to the movement of the drum to continue transport in the same direction with a precision alignment and spacing identical to that between said notches, and conveyor means synchronously moving with rotation of said rotary member for receiving the papers in said precision spacing and alignment for transport away from the rotary member to on-line processing stations.

2. The system defined in claim 1 including means for synchronizing the rotation speed of said timing member with the delivery of papers from said press.

* * * * *